US006043446A

United States Patent [19]

Mayo et al.

[11] Patent Number: 6,043,446

[45] Date of Patent: Mar. 28, 2000

[54] VACUUM SWITCH INCLUDING SHIELD AND BELLOWS MOUNTED ON ELECTRODE SUPPORT STRUCTURE LOCATED IN ELECTRODE CIRCUMFERENTIAL GROOVE

[75] Inventors: Stephen David Mayo, Horseheads, N.Y.; Steven Theodore Vittorio, Frisco, Tex.; Scott Ray Lanning, Bellefontaine, Ohio; Michael Laurence Hursh, Printed Post, N.Y.

[73] Assignee: Eaton Corporation, Cleveland, Ohio

[21] Appl. No.: 09/326,966

[22] Filed: Jun. 7, 1999

[51] Int. Cl.[7] ..... H01H 33/66

[52] U.S. Cl. ..... 218/134; 218/135

[58] Field of Search ..... 218/123–129, 218/134–137, 140

[56] References Cited

U.S. PATENT DOCUMENTS 3,996,437 12/1976 Selzer ..... 218/135 X
4,081,640 3/1978 Rich .
4,414,448 11/1983 Kashimoto et al. ..... 218/136
4,481,390 11/1984 Kashiwagi et al. ..... 218/136 X
4,707,577 11/1987 Tamaki et al. .
5,543,598 8/1996 Duffour et al. ..... 218/135
5,777,287 7/1998 Mayo .
5,793,008 8/1998 Mayo et al. .

*Primary Examiner*—J. R. Scott
*Attorney, Agent, or Firm*—Martin J. Moran

[57] ABSTRACT

An assembly and associated method are provided for use with the stationary and moveable contact sub-assembly portions of a vacuum interrupter. This assembly employs a groove machined circumferentially into an electrode of the sub-assembly in conjunction with a retaining ring apparatus having a first portion inserted into the groove. A second portion of the retaining ring provides stable structural support to components stacked onto the retaining ring apparatus. The components are clamped together and brazing material is placed across junctions between and among the individual vacuum interrupter components. Methods for constructing a vacuum interrupter sub-assembly in conjunction with brazing processes are also disclosed.

13 Claims, 3 Drawing Sheets

VACUUM SWITCH INCLUDING SHIELD AND BELLOWS MOUNTED ON ELECTRODE SUPPORT STRUCTURE LOCATED IN ELECTRODE CIRCUMFERENTIAL GROOVE

BACKGROUND OF THE INVENTION

1. Field of the Invention

The present invention generally relates to an apparatus and associated method for supporting sub-assembly components during their construction in a manufacturing process. The present invention more particularly relates to an apparatus and associated method for supporting sub-assembly portions of a vacuum interrupter during their manufacture.

2. Description of the Prior Art

Vacuum interrupters are typically used to interrupt medium and high voltage AC currents. The interrupters include a generally cylindrical vacuum envelope surrounding a pair of coaxially aligned separable contact assemblies having opposing contact surfaces. The contact surfaces abut one another in a closed circuit position and are separated to open the circuit. Each electrode assembly is connected to a current carrying terminal post extending outside the vacuum envelope and connecting to an AC circuit. The subject matter of U.S. Pat. Nos. 5,777,287 and 5,793,008 provide examples of conventional vacuum interrupter technology.

Conventional support construction applies to sub-assemblies for both (1) a stationary vacuum interrupter electrode and its end plate, and (2) a moveable vacuum interrupter electrode and associated components supported by the electrode, such as the bellows and bellows shield. This conventional construction requires that a structural support step or ledge be machined into the electrode body to provide a stable location onto which parts may be stacked for further production processing, such as brazing.

The material removed by machining this ledge produces an electrode with a smaller cross-sectional area. This reduction in cross-sectional area causes the current density of the electrode to increase during operation. An increase in current density unfavorably results in increased heat generated by current passing through the electrode. As the current density in the electrode decreases, however, the heat generated by the electrode will decrease as well. By increasing the cross-sectional area of the electrode, or by reducing the amount of material machined from the electrode, it becomes possible to increase the amount of continuous current passed through the electrode without exceeding operational temperature limits for the electrode. In addition, current density is a function of the square of the cross-sectional area of the electrode. As a result, a reduction in the amount of material removed from the electrode can decrease the current carrying capacity of the electrode as a function of a squared variable, namely the cross-sectional area of the electrode.

To form the ledge or step in the electrode, a significant portion of material must be machined from the electrode on an automatic or manual lathe and discarded. In addition, conventional practice for production of a vacuum interrupter electrode sub-assembly necessitates providing a staking ring mechanically engaging the electrode to support and maintain the positioning of components, such as the bellows and bellows shield, which are supported by the electrode. The staking ring is specifically employed to prepare the electrode sub-assembly and its associated components for a subsequent brazing operation.

In spite of the foregoing methods for constructing stationary and moveable electrode sub-assemblies, there remains a real and substantial need for an apparatus and method of construction to minimize the problems associated with conventional vacuum interrupter manufacturing practices.

SUMMARY OF THE INVENTION

The manufacturing apparatus and method of the present invention have significantly improved on those industry practices commonly utilized and known in the prior art with respect to vacuum interrupters.

In accordance with one aspect of the present invention, an assembly is provided for use with a moveable contact sub-assembly of a vacuum interrupter. The moveable portion of the vacuum interrupter comprises an electrode and at least one component supported adjacent to the electrode.

A support assembly is provided which comprises an apparatus such as a spiral retaining ring having first and second portions. The first portion of the spiral retaining ring is disposed in a groove formed in the electrode of the moveable contact sub-assembly. The second portion of the spiral retaining ring extends beyond the exterior surface of the electrode to provide a support ledge. Vacuum interrupter components can then be stacked in position against the support ledge. A device such as a component retaining ring can be employed to clamp the stacked components between the component retaining ring and the support ledge formed by the spiral retaining ring. Finally, a braze is applied to the assembly to form a vacuum seal at the points of contact between and among the groove, the retaining rings, and the supported components.

In accordance with another aspect of the present invention, an assembly is provided for use with a stationary contact sub-assembly portion of a vacuum interrupter. A stationary contact sub-assembly comprises an electrode extending through an orifice formed in an end plate. An assembly intended for use with this stationary contact sub-assembly comprises an apparatus, such as a spiral retaining ring, having first and second portions. The first portion of the spiral retaining ring is disposed in a groove formed in the electrode. The second portion of the spiral retaining ring extends a distance from the exterior surface of the electrode to form a support ledge. The support ledge works against the force of gravity to provide support and stability to an end plate disposed around the exterior circumference of the electrode. A braze is applied to the assembly to provide for a vacuum seal in subsequent vacuum interrupter manufacturing processing.

In a method embodiment of the present invention, a method for assembling sub-assembly portions of a vacuum interrupter is provided. The method begins by machining a groove into an electrode, such as with a manual or automatic lathe. The electrode is stabilized in a fixture and a device such as a spiral retaining ring is inserted into the groove formed in the electrode. The spiral retaining ring, in this embodiment, has both an engaging portion which extends radially inwardly a depth selected into the groove, and a support portion which extends beyond the exterior surface of the electrode to provide a support ledge. For purposes of manufacturing a moveable contact sub-assembly of a vacuum interrupter, components can be stacked on top of the support ledge provided by the support portion discussed above.

The method of the present invention also includes providing an apparatus, such as a component retaining ring, which securely contains or clamps components stacked on the support ledge. The method then includes brazing the component retaining ring to the stack of components to establish a vacuum seal for the sub-assembly in its final assembly within the vacuum interrupter. The brazing step also establishes electrical contact between the electrode and the retaining ring.

By machining a relatively smaller groove into the electrode, processing time on a lathe is reduced by several minutes per part. This results in an increase in the volume of parts that can be made on the machine for a given period and improves overall production efficiency. A component retaining ring may be used to clamp together the stack of components which assists production assembly of the vacuum interrupter by avoiding use of the mechanical engagement necessitated by conventional use of staking rings. The spiral retaining ring is positioned in the groove and the component retaining ring is pressed down over the components stacked on the spiral retaining ring. The entire assembly, including the components supported on the electrode, becomes substantially rigid and is prepared for brazing or additional production processing. The apparatus and the production method of the present invention both provide substantial improvements over the prior art cycle time for completing manufacture of the vacuum interrupter sub-assemblies.

The present invention also offers the advantage of increasing the cross-sectional area of the electrode by reducing the amount of material machined from the electrode. The amount of continuous current passed through the electrode may then be increased without exceeding the operational temperature limits of the electrode. The present invention decreases current density through the electrode as a function of an increase in the cross-sectional area of the electrode.

It is an object of the present invention to provide an assembly for use with a vacuum interrupter sub-assembly which reduces the amount of material machined from an elongated electrode during manufacturing processing.

It is another object of the present invention to provide an assembly which substantially reduces the cycle time necessary to construct both the stationary and moveable contact sub-assembly portions of a vacuum interrupter.

It is another object of the present invention to eliminate unnecessary production steps precursory to brazing operations and subsequent manufacturing operations for the sub-assembly portions of a vacuum interrupter.

It is another object of the present invention to reduce the amount of operator skill required to construct vacuum interrupter sub-assemblies.

These and other objects of the present invention will be more fully understood from the following description of the invention on reference to the illustrations appended hereto.

BRIEF DESCRIPTION OF THE DRAWINGS

Prior art

Prior art

DETAILED DESCRIPTION OF THE INVENTION

Figure 1:
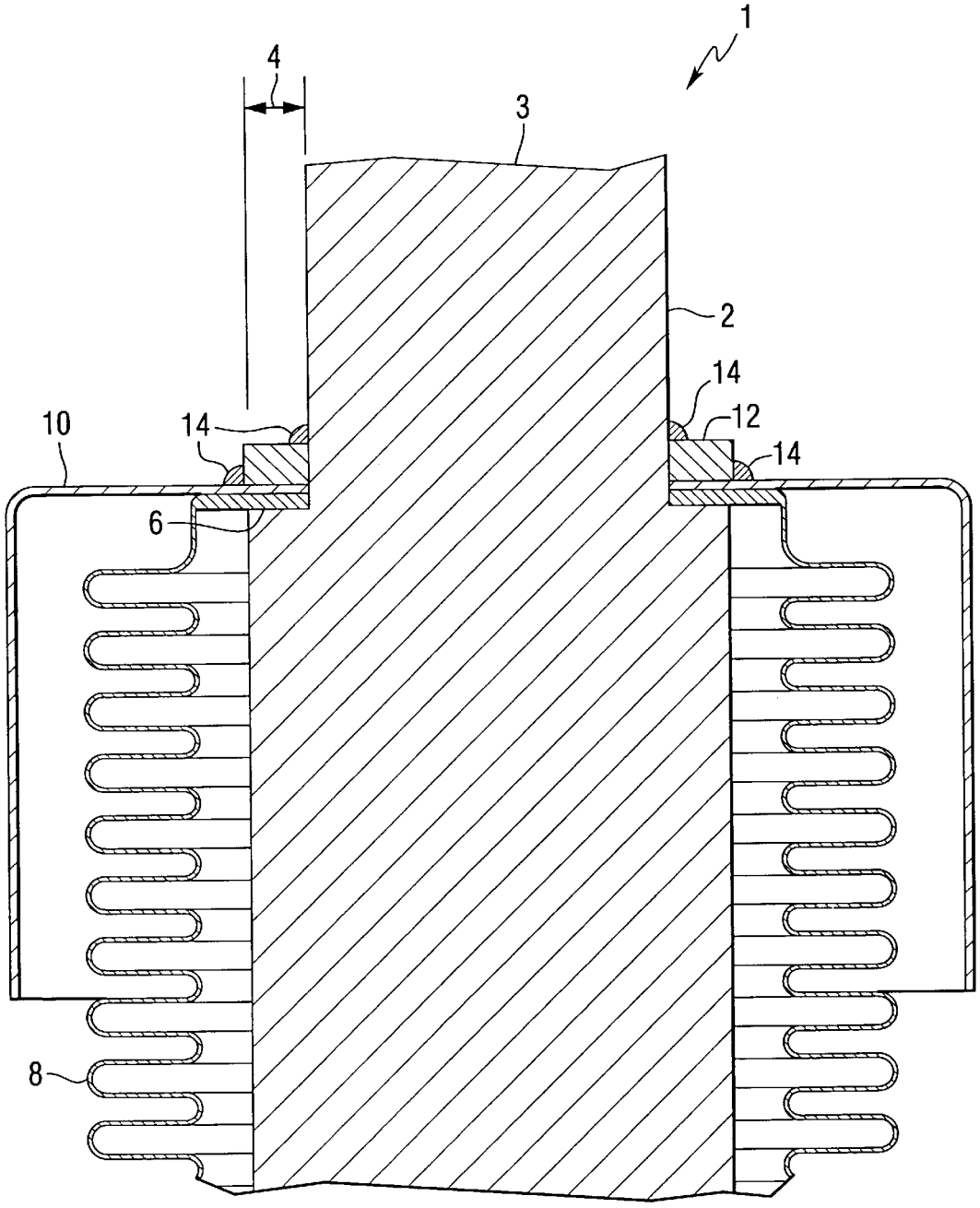
FIG. 1 PRIOR ART
FIG. 1 is a longitudinal sectional view through a structural arrangement for the moveable contact sub-assembly of a vacuum interrupter.

Referring now to FIG. 1, a conventional construction of a moveable contact sub-assembly 1 of a vacuum interrupter is provided. The moveable contact sub-assembly 1 comprises an elongated electrode 2 which has had a substantial portion of its circumference machined away by a depth 4 in a particular area which may be near the contact end 3 of the electrode 2. This provides a ledge 6 which allows for components such as the bellows 8 and the bellows shield 10 to be stacked and supported on the ledge 6. In a subsequent manufacturing process, a staking ring 12 is positioned on the components 8 and 10 to contain these components 8 and 10 securely between the staking ring 12 and the support ledge 6. A conventional metal awl or punch may be employed to strike the staking ring 12 forming indentations (not shown) which tack the staking ring 12 to the electrode 2. The staking ring 12 may be comprised of standard bar stock. The staking ring 12 is then brazed with braze material 14 in a conventional manner at locations between and among the staking ring 12, the contact end 3 and the bellows shield 10.

Figure 2:
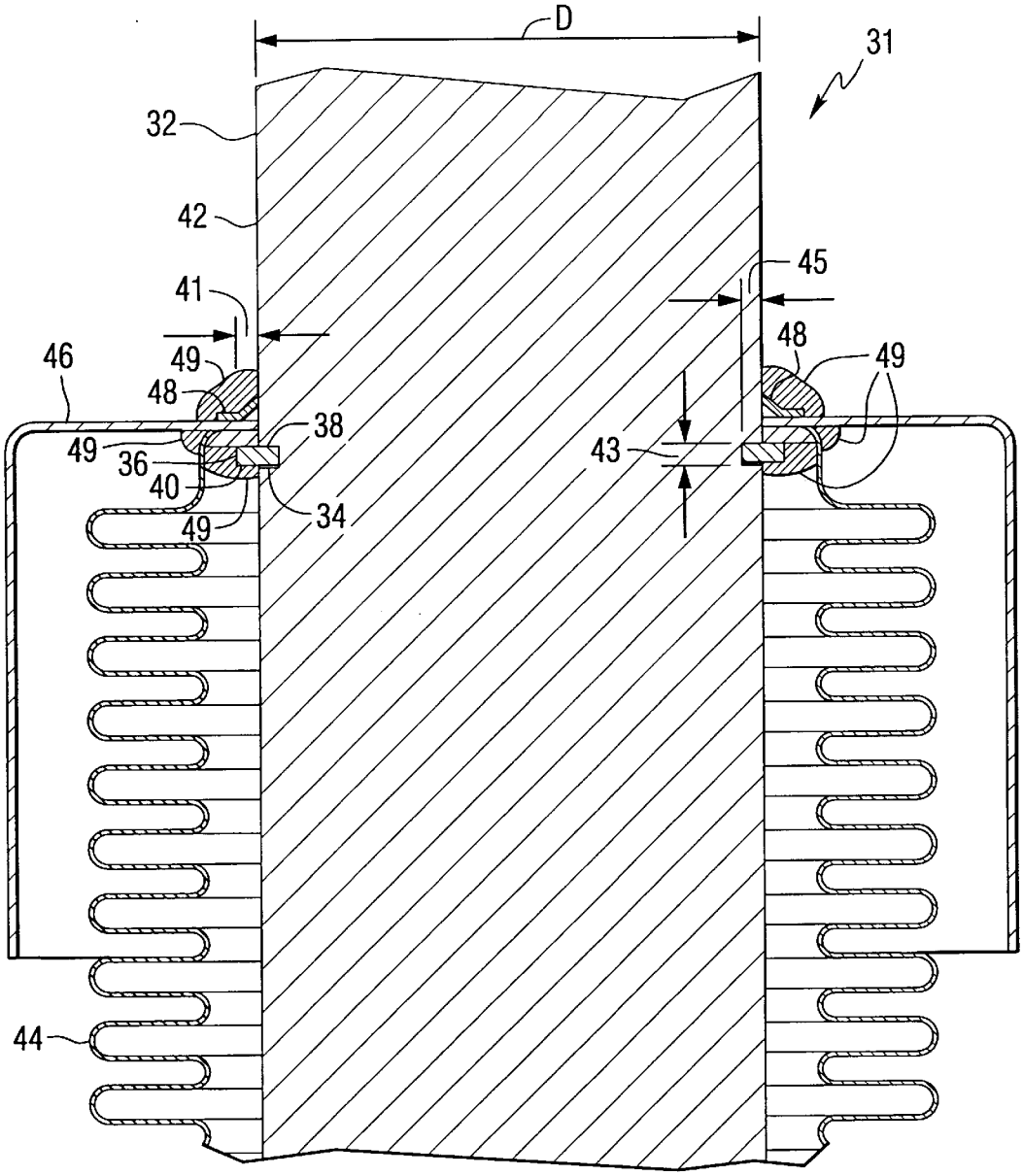
FIG. 2 is a longitudinal sectional view through the structure of the present invention depicting its use with the moveable contact sub-assembly of the vacuum interrupter.
Figure 3:
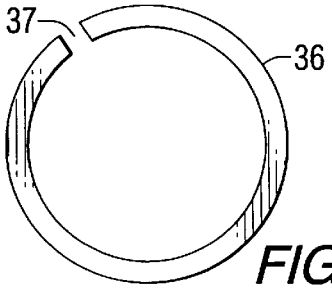
FIG. 3 is a plan view of a retaining ring employed in the present invention.

Referring now to FIGS. 2 and 3 of the present invention, a moveable contact sub-assembly 31 of a vacuum interrupter is provided with an electrode 32 having a groove 34 machined preferably around substantially the entire circumference of the electrode 32. The groove 34 is preferably machined to a width 43 of at least about 0.055 to 0.065 inches and a depth 45 of at least about 0.035 to 0.045 inches.

Referring again to FIGS. 2 and 3, an apparatus such as a spiral retaining ring 36 is disposed in the groove 34. The spiral retaining ring 36 has a first portion 38 extending into the groove 34 and a second portion 40 extending a distance 41 from the exterior surface 42 of the electrode 32. The first portion 38 preferably substantially fills the groove 34. The spiral retaining ring 36 may have a gap 37 disposed in a portion of its circumference. The spiral retaining ring 36 is preferably embodied as a conventional radial spring which is capable of expansion and contraction about its geometric center and which can extend around the circumference of the electrode 32 for more than one revolution and preferably for at least two revolutions. It will be appreciated that the spiral retaining ring 36 can be any retaining ring suitable for providing adequate support to components which are brazed to form a vacuum tight seal in subsequent manufacture. Components including the bellows 44 and bellows shield 46 are stacked onto the second portion 40 of the spiral retaining ring 36.

Figure 4:
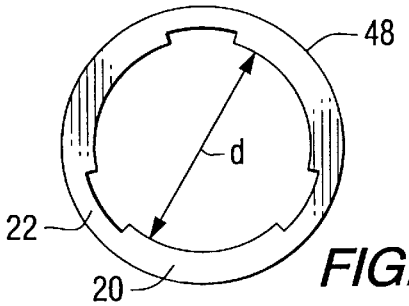
FIG. 4 is a plan view of a component retaining ring employed in an aspect of the present invention.

Referring now to FIGS. 2 through 4, a component retaining ring 48 is circumferentially engaged around the electrode 32 in substantially intimate contact with the stacked components, which may include the bellows 44 and the bellows shield 46. The component retaining ring 48 is structured to contain or clamp securely the stack of components between the component retaining ring 48 and the second portion 40 of the spiral retaining ring 36. In its use, the component retaining ring 48 need not extend substantially continuously around the entire circumference of the electrode 32, but it must exert sufficient force against a stack of components to enable a subsequent brazing operation to establish a vacuum seal for the clamped stack of components. As shown more particularly in FIG. 4, the component retaining ring 48 can be provided with alternating projection regions 20 and relief regions 22. The component retaining ring 48 can also have a structure substantially the same as the spiral retaining ring 36 discussed previously. The component retaining ring 48 can also be provided with an inside diameter d which is less than the outside diameter D of the electrode 32, so that the component retaining ring 48 "bites" into the electrode 32, particularly with the projection regions 20, when it is positioned around the circumference of the electrode 32 and is used to clamp and secure components such as the bellows 44 and bellows shield 46.

Referring again to FIG. 2, braze material 49 is applied to selected areas between and among the stack of components, the electrode, and the retaining rings. This provides a vacuum seal within the sub-assembly 31 for its inclusion in a vacuum interrupter in subsequent manufacturing operations. The braze material 49 can be provided as a conventional solid type braze material which melts and adheres to the sub-assembly and its components in a heating operation associated with the brazing operation. The electrode 32 is conventionally composed of copper or a copper alloy. The bellows 44 and bellows shield 46 are preferably composed of stainless steel. The bellows 44 is preferably provided as a thin metal, conventional bellows. The retaining ring 36 preferably has a generally rectangular cross-section. The retaining ring 36 is composed of a material selected from the group consisting of stainless steel, carbon steel, and spring steel.

Figure 5:
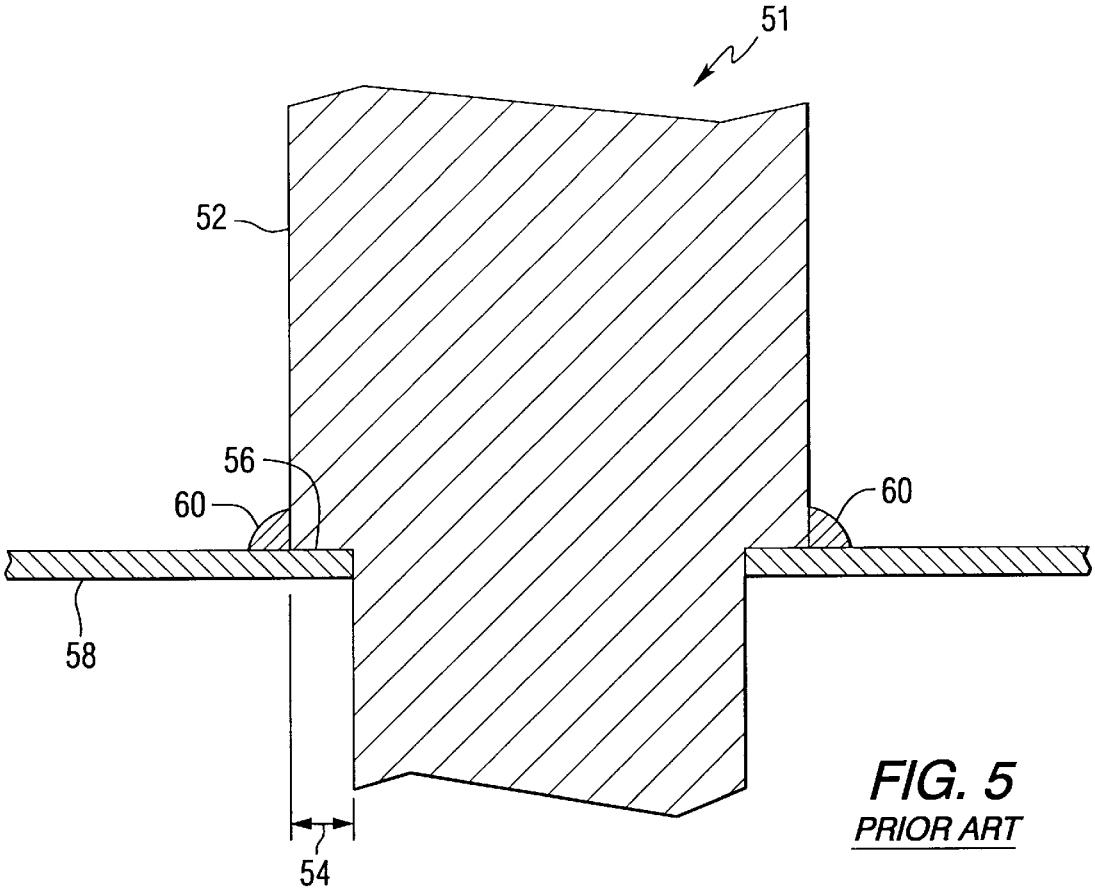
FIG. 5 PRIOR ART
FIG. 5 is a longitudinal sectional view through a structural arrangement for the stationary contact sub-assembly of the vacuum interrupter; and, FIG. 6 is a longitudinal sectional view through the assembly of the present invention as applied to the stationary contact sub-assembly of the vacuum interrupter.

Referring now to FIG. 5, a conventional manufacturing construction for a stationary contact sub-assembly 51 of a vacuum interrupter is provided. In this embodiment, the electrode 52 has a depth 54 of material machined and removed from the electrode 52. The machining process forms a ledge 56 which provides support for the electrode 52 as it rests on the ledge 56 in stable and substantially intimate contact with an end plate 58. The electrode 52 is held in place substantially by the force exerted by the weight of electrode 52 as it bears against end plate 58. Braze material 60 is then applied to seal the junction points between electrode 52 and end plate 58.

Figure 6:
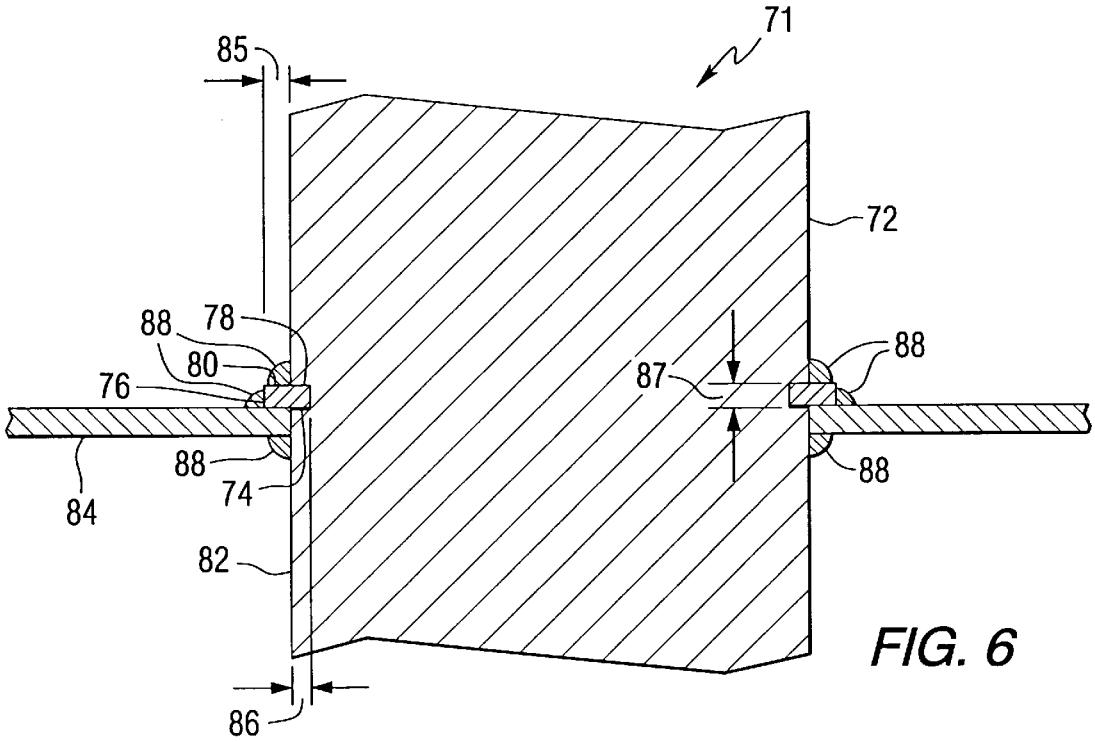

Referring now to FIG. 6 of the present invention, the assembly of the present invention is provided in a stationary contact sub-assembly 71 of a vacuum interrupter. The stationary contact sub-assembly 71 comprises an electrode 72 which has a groove 74 machined into the electrode 72 which extends around substantially the entire circumference of the electrode 72. A spiral retaining ring 76 is disposed in the groove 74 and has a first portion 78 extending into the groove 74 of the electrode 72, and a second portion 80 extending from an exterior surface 82 of the electrode 72. The second portion 80 of the spiral retaining ring 76 provides stable and intimate structural support with an end plate 84 against the force of gravity. The second portion 80 extends a distance 85 from the exterior surface 82 of the electrode 72. The groove 74 is machined into the electrode 72 to a depth 86 and a width 87. The depth 86 is preferably from about 0.035 to 0.045 inches. The width 87 of the groove 74 is preferably from about 0.055 to 0.065 inches. A braze material 88 is provided to braze the junctions of contact between and among the retaining ring 76, the end plate 84, and the electrode 72. The spiral retaining ring 76 is preferably generally rectangular in cross-section and extends around the circumference of the electrode 72 for preferably at least two revolutions.

In a method embodiment of the present invention, a method for assembling a vacuum interrupter sub-assembly is provided. The method begins by machining a circumferential groove into an electrode. The machining step may be performed with a hand lathe or on an automatic or CNC lathe. The electrode is stabilized in a fixture during assembly. A support device having first and second portions, such as a spiral retaining ring, is inserted with its first portion releasably engaged within the circumferential groove. The second portion of the support device extends beyond the exterior surface of the electrode and provides a support ledge for components which are then stacked onto the support ledge. In an additional aspect of the method of the present invention, the components are securely and rigidly clamped together on the support ledge by an apparatus such as a spiral retaining ring. The spiral retaining ring and other components are then brazed to establish a vacuum tight seal within the vacuum interrupter and to provide electrical contact between the spiral retaining ring and the electrode.

Whereas particular embodiments of the invention have been described for purposes of illustration, it will be evident to those skilled in the art that numerous variations of the details may be made without departing from the invention as defined in the appended claims.

What is claimed is:

1. A vacuum interrupter contact assembly, comprising:

an elongated electrode having a circumferential groove formed a selected depth into said electrode;

support means having a first portion disposed in said groove and a second portion extending a distance from the exterior of said electrode;

at least one vacuum interrupter component supported on said support means;

clamping means, engaged around the circumference of said electrode, for clamping said at least one vacuum interrupter component against said support means; and, a braze sealingly disposed on said clamping means and said at least one vacuum interrupter component to establish a vacuum seal.

2. The assembly of claim 1, wherein said at least one vacuum interrupter component includes a bellows and a bellows shield supported on said support means.

3. The assembly of claim 1, wherein said groove extends around substantially the entire circumference of said electrode.

4. The assembly of claim 1, wherein said support means includes a spiral retaining ring having a generally rectangular cross-section.

5. The assembly of claim 1, wherein said clamping means includes alternating protection and relief regions extending around said circumference of said electrode.

6. The assembly of claim 1, wherein said support means extends around said electrode for at least two revolutions.

7. An assembly for stabilizing and brazing a vacuum interrupter sub-assembly, comprising:

an elongated electrode having a circumferential groove formed in said electrode;

support means, having a first portion disposed in said groove and a second portion extending a distance from the exterior of said electrode;

an end plate supported against said second portion of said support means; and, a braze sealingly disposed on said support means and said end plate.

8. The assembly of claim 7, wherein said groove extends around substantially the entire circumference of said electrode.

9. The assembly of claim 7, wherein said support means includes a spiral retaining ring having a generally rectangular cross-section.

10. The assembly of claim 7, wherein said support means extends around the circumference of said electrode for at least two revolutions.

11. A method for stabilizing and brazing a vacuum interrupter contact sub-assembly comprising:

machining a circumferential groove a selected depth into an electrode;

providing support means, having first and second portions;

inserting said first portion into said groove to engage said support means;

stacking at least one component of said vacuum interrupter onto said second portion to support said at least one component;

clamping said component against said second portion with a clamping means; and brazing said clamping means and said at least one component to establish a vacuum seal within said sub-assembly.

12. The method of claim 11, wherein said clamping said at least one component includes clamping a bellows shield to a bellows against said second portion.

13. A method for stabilizing an elongated vacuum interrupter electrode and its associated components for brazing in a vacuum interrupter sub-assembly, comprising:

machining a circumferential groove in said electrode;

providing support means, having first and second portions;

positioning said first portion in said groove;

stacking an end plate against said second portion; and, brazing said support means to said electrode and to said end plate.

* * * * *